US007568599B2

(12) United States Patent
Hall

(10) Patent No.: US 7,568,599 B2
(45) Date of Patent: Aug. 4, 2009

(54) SKI TOTE INCLUDING A BACKPACK STRAP FOR CARRYING A PAIR OF SKIS

(76) Inventor: Julie Hall, 4514 E. Verbena Dr., Phoenix, AZ (US) 85044

( * ) Notice: Subject to any disclaimer, the term of this patent is extended or adjusted under 35 U.S.C. 154(b) by 638 days.

(21) Appl. No.: 11/249,885

(22) Filed: Oct. 12, 2005

(65) Prior Publication Data

US 2006/0076378 A1 Apr. 13, 2006

Related U.S. Application Data

(60) Provisional application No. 60/618,118, filed on Oct. 12, 2004.

(51) Int. Cl.
*A45F 3/04* (2006.01)

(52) U.S. Cl. ..... 224/250; 224/655; 224/651; 224/917

(58) Field of Classification Search ..... 224/147, 224/149, 150, 199, 655, 647, 650, 651, 616, 224/617, 618, 68, 917, 680, 250, 257; 294/147
See application file for complete search history.

(56) References Cited

U.S. PATENT DOCUMENTS

| | | | | |
|---|---|---|---|---|
| 3,368,655 | A | 2/1968 | Purdy | |
| 4,002,277 | A * | 1/1977 | Westerholm | 294/147 |
| 4,308,982 | A | 1/1982 | Hall | |
| 4,518,107 | A | 5/1985 | Amos | |
| 4,648,121 | A | 3/1987 | Lowe | |
| 4,673,118 | A | 6/1987 | Kronz | |
| 4,674,787 | A | 6/1987 | DeVera | |
| 4,903,875 | A * | 2/1990 | Smart et al. | 224/258 |
| 4,958,760 | A | 9/1990 | Mule et al. | |
| 4,982,883 | A | 1/1991 | Ullal et al. | |
| 5,318,209 | A * | 6/1994 | Rader et al. | 294/147 |
| 5,400,937 | A * | 3/1995 | Rottenberg | 224/258 |
| 5,540,364 | A | 7/1996 | Krieger et al. | |
| 5,575,412 | A * | 11/1996 | Arias | 224/257 |
| 5,803,332 | A * | 9/1998 | Thompson | 224/651 |
| 5,961,017 | A * | 10/1999 | Mehler | 224/576 |
| 5,979,726 | A * | 11/1999 | Chisholm et al. | 224/578 |
| 5,988,474 | A | 11/1999 | Smith, II et al. | |
| 6,010,051 | A * | 1/2000 | Callanan | 224/651 |
| 6,152,338 | A * | 11/2000 | Smith | 224/149 |
| 6,290,114 | B1 * | 9/2001 | Berberian | 224/642 |
| 6,536,638 | B1 | 3/2003 | Gulmatico, III | |
| 2003/0173382 | A1 | 9/2003 | Robinson | |
| 2004/0245297 | A1 * | 12/2004 | Sinclair | 224/150 |

* cited by examiner

*Primary Examiner*—Nathan J Newhouse
*Assistant Examiner*—John Cogill
(74) *Attorney, Agent, or Firm*—Schmeiser, Olsen & Watts LLP

(57) ABSTRACT

A ski tote may include at least one backpack strap and/or a basic strap for holding the skis together for aid in carrying a pair of skis. The tote may also include one or more shoulder straps. The basic strap may extend longitudinally between a first end and a second end. The basic strap may have a bifurcated straps integral with or connected to first and second ends of the basic strap. Each of first and second bifurcated straps may have first and second straddling ends and a ski surrounding loop mechanism on each of the first and second straddling ends. The backpack strap may include a ski supporting substrate with one or more ski supporting straps attached to a ski supporting substrate. A pair of shoulder straps may also be attached to the substrate.

7 Claims, 4 Drawing Sheets

SKI TOTE INCLUDING A BACKPACK STRAP FOR CARRYING A PAIR OF SKIS

This application claims priority to the earlier provisional application entitled "SKI TOTE INCLUDING A BACKPACK STRAP FOR CARRYING A PAIR OF SKIS," Ser. No. 60/618,118, filed Oct. 12, 2004, the disclosures of which are hereby incorporated herein by reference.

BACKGROUND OF THE INVENTION

1. Technical Field

This invention generally relates to devices that facilitate keeping a pair of skis together and that provide a support that can be engaged by a user, and specifically to a device that provides a handle, shoulder strap, and/or backpack configuration together with specific ski engaging mechanisms that support and hold the skies together for ease of handling and transport.

2. State of the Art

Skiing is a very popular sport in many parts of the world. In particular in those areas such as Switzerland and the western United States which have very mountainous terrain. One of the biggest struggles skiers are presented with is how to comfortably and safely carry their skis and skiing gear.

Throughout the years, many different types of ski carriers have been developed. United States Patent Application No. US 2003/0173382 for example, discloses a pair of straps which go over the user's shoulders and then attach to a pair of skis by upper and a lower flexible loops. The user places his/her skis through the flexible loops and carries the skis and straps loosely slung over his/her shoulders similar to backpack straps. The skis are carried loosely against the user's back.

A more traditional ski bag is disclosed in U.S. Pat. No. 6,536,638 issued to Gulmatico. The traditional ski bag is a flexible fabric bag which encloses the entire set of skis and poles. The bag is attached to a shoulder strap by which the user carries his/her skis.

Many variations of the ski carriers and ski bags disclosed in these documents have been developed throughout the years. None of these devices, however, have provided an adequate system for carrying skis and accessories in an easily accessible manner. Accordingly, what is needed is a ski tote that carries a pair of skis and allows the user to carry their accessories in an easily accessible manner.

DISCLOSURE OF THE INVENTION

The present invention relates to devices that facilitate keeping a pair of skis together and that provide a support that can be engaged by a user, and specifically to a device that provides a handle, shoulder strap, and/or backpack configuration together with specific ski engaging mechanisms that support and hold the skies together for ease of handling and transport.

In a simple form, the present invention may take the form of a ski tote basic strap for holding a pair of skis together and to facilitating lifting, orienting, and carrying of the pair of skis as a unit. The basic strap may include a basic main strap extending longitudinally between a first end and a second end. A first bifurcated strap may be connected to the first end of the basic main strap. The first bifurcated strap may have first and second straddling ends. Similarly, a second bifurcated strap may be connected to the second end of the basic main strap. The second bifurcated strap may have first and second straddling ends. A ski holding mechanism may be provided on each of the first and second straddling ends of each of the first and second bifurcated straps.

The ski tote basic strap may include one or more locking grommets secured to the basic main strap for lockingly receiving a cable therethrough. The ski tote basic strap may include at least one quick release device connected to the basic main strap for securing a shoulder strap thereto. The shoulder strap may be connected to the basic main strap by the quick release device. The ski tote basic strap may include two to four quick release devices including the at least one quick release device. At least one of the quick release devices may be for supporting ski gear thereon. The ski tote basic strap may include at least one padded handle removeably supported on the basic main strap.

In another simple form, the present invention may take the form of a backpack strap for holding a pair of skis together and facilitating lifting, orienting, and carrying of the pair of skis as a unit. The backpack strap may include a ski supporting substrate that has a closed configuration and an open configuration. The substrate may be capable of being overlapped on itself to provide the closed configuration. At least one ski supporting strap may be attached to a ski bearing side of the substrate. The ski supporting strap may have a V-shaped configuration for engaging a binding of a ski. Alternatively, ski supporting strap(s) may be provided as straps forming adjustably closeable loops that may be securely engaged around one or both of a pair of skis. This may be achieved by hook and loop fasteners, buckles, drawstrings, and/or cords and mechanically releaseable clamps for slideable adjustment. A pair of shoulder straps may be attached to the substrate to facilitate carrying of the backpack strap and skis in a manner similar to carrying a backpack.

The backpack strap may include a closing mechanism for holding the substrate in an overlapped condition in the closed configuration. This closing mechanism may be provided by one or more of hook and loop fasteners, a zipper, buttons, clasps, and hooks and eyes. The substrate may have a trifold configuration for overlapping at least two portions of the substrate on another portion in the closed configuration. A portion of the substrate that overlaps on itself may also cover the ski supporting strap. The backpack strap may include a plurality of ski supporting straps.

The backpack strap may include a protective material disposed in or on the substrate between a surface of a ski engaging side of the substrate and an opposite back engaging side of the substrate.

The backpack strap may include at least one locking grommet in the substrate for receiving a cable or other locking device. The backpack strap may include at least one accessory support on the substrate, for removeably supporting an accessory. The accessory support may include a closeable pocket or ski gear. The closeable carry bag may have a quick attachment element thereon. The quick attachment element may be separably attachable to the accessory support.

It is to be understood that the backpack strap may include a ski tote basic strap, as described above, useable in combination with the backpack strap to further aid in holding the pair of skis together In another simple form, the present invention may take the form of a method of supporting, orienting and carrying of the pair of skis as a unit. The method may include one or more of: surrounding a first portion of a ski superjacent to a first binding by a first straddling end of a basic strap, surrounding a second portion of the ski subjacent the first binding by a second straddling end of the basic strap, surrounding a third portion of the ski subjacent a second binding by a third straddling end of the basic strap, and surrounding a fourth portion of the ski superjacent the second binding by a fourth straddling end of the basic strap.

The method may include adjusting the length of the basic strap to have minimal slack to facilitate manipulation of the skis by a user. This step may advantageously reduce floppiness during carrying and reorientation of the skis to which the basic strap is attached. The method may also include attaching a shoulder strap to the basic strap and supporting the basic strap and the skis by the shoulder strap on a user's shoulder.

The method may further include placing the skis and the basic strap within a backpack strap. The step of placing may include supporting at least one ski binding in a ski engaging strap attached to the backpack strap. The step of placing may include closing the backpack strap by surrounding the skis with a substrate of the backpack strap and/or securing the backpack strap in a closed configuration by attaching the substrate to itself.

The method may further include supporting at least one shoulder engaging member that is attached to the substrate on a back of a user. Thus, the method may include supporting the backpack strap and the skis on the back of the user.

It is to be understood that the method of supporting, orienting, and carrying the pair of skis as a unit may include one or more of: placing the skis within a backpack strap, supporting at least one ski binding in a ski engaging strap attached to the backpack strap, closing the backpack strap by surrounding the skis with a substrate of the backpack strap, securing the backpack strap in a closed configuration by attaching the substrate to itself; and supporting the skis on a back of a user by at least one shoulder engaging member attached to the substrate. These steps may be achieved without attaching the basic strap described above to the skis.

Some of the advantages of the present invention include the provision of light weight carrying strap(s) for skis. The invention in any of its simple forms may provide an all-in-one design that permits supporting, orienting, and carrying skis, as well as mechanisms for carrying accessories. The strap(s) may be folded into a pocket of the invention that may be integral with one of the straps or may be separate from the straps. In at least one of its simple forms, a strap of the invention may be worn by the user. The straps may be locked to a ski rack by itself or together with a pair of skis. The strap(s) and methods of the present invention provide the advantage of stability for carrying in each of the basic strap, shoulder carry, and backpack strap configurations. Furthermore, the configuration can be quickly and easily changed. D-rings may be connected at a variety of locations on any of the straps to provide for accessory attachment. The accessories that may be removably supported on the straps of the present invention may include, but are not limited to, one or more of: gloves, goggles or goggle totes, hats, ski pass pockets, water carrying device (which may include straps that hold a water container), a strap-stash pocket (which may take the form of a fold in pocket that folds into itself or another pocket, and may include a clip to hang on a belt). Thus, the straps of the present invention may have one or more of a glove clip, goggle tote clip, hat clip, ski pass pocket clip, water carrying device clip, and a strap-stash pocket clip. The corresponding accessories may have attachment clips for mating engagement with these clips for the accessories. These accessories may also be provided as part of the invention. For example, a goggle tote may be provided as a fleece or otherwise padded pouch similar to the fold in pocket described above. This goggle tote may include a grommet for attachment or locking to other components or a ski rack.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As discussed above, this invention generally relates to devices that facilitate keeping a pair of skis together and that provide a support that can be engaged by a user, and specifically to a device that provides a handle, shoulder strap, and/or backpack configuration together with specific ski engaging mechanisms that support and hold the skies together for ease of handling and transport.

Figure 1A:
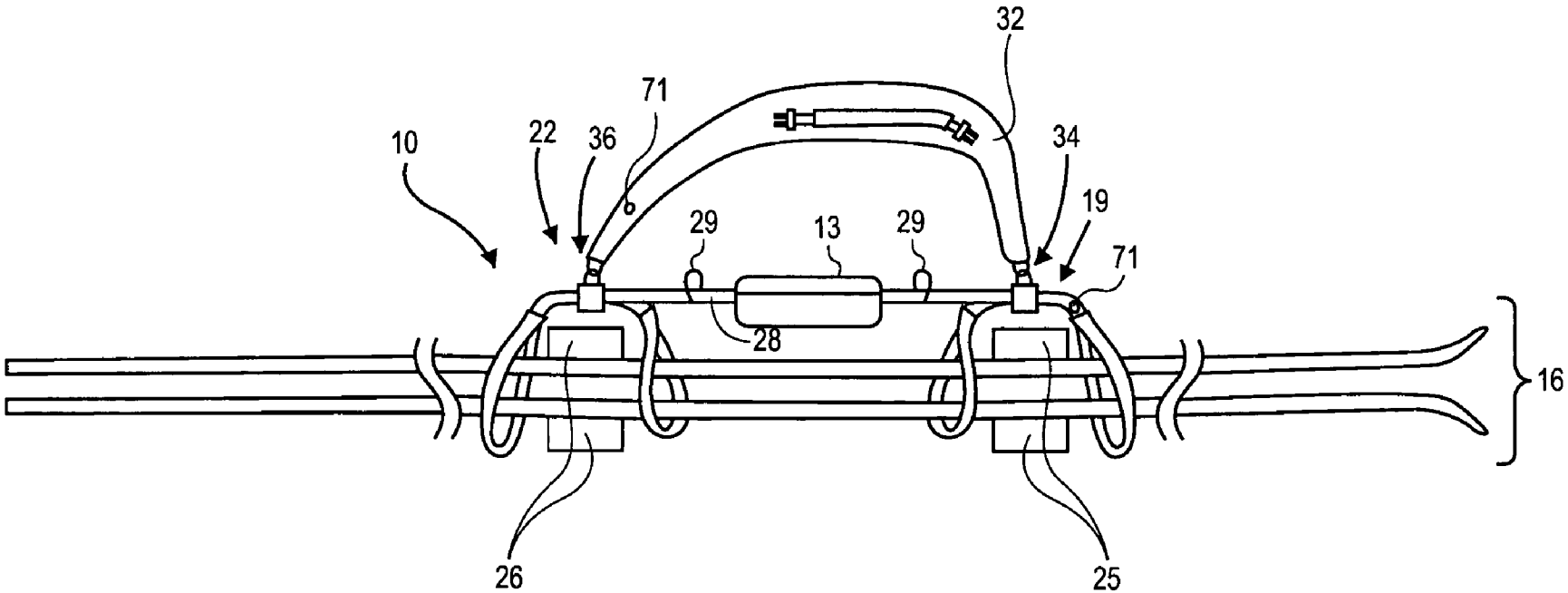
FIG. 1A is a side plan view of a basic strap on a pair of skis according to an embodiment of the present invention.
Figure 1B:
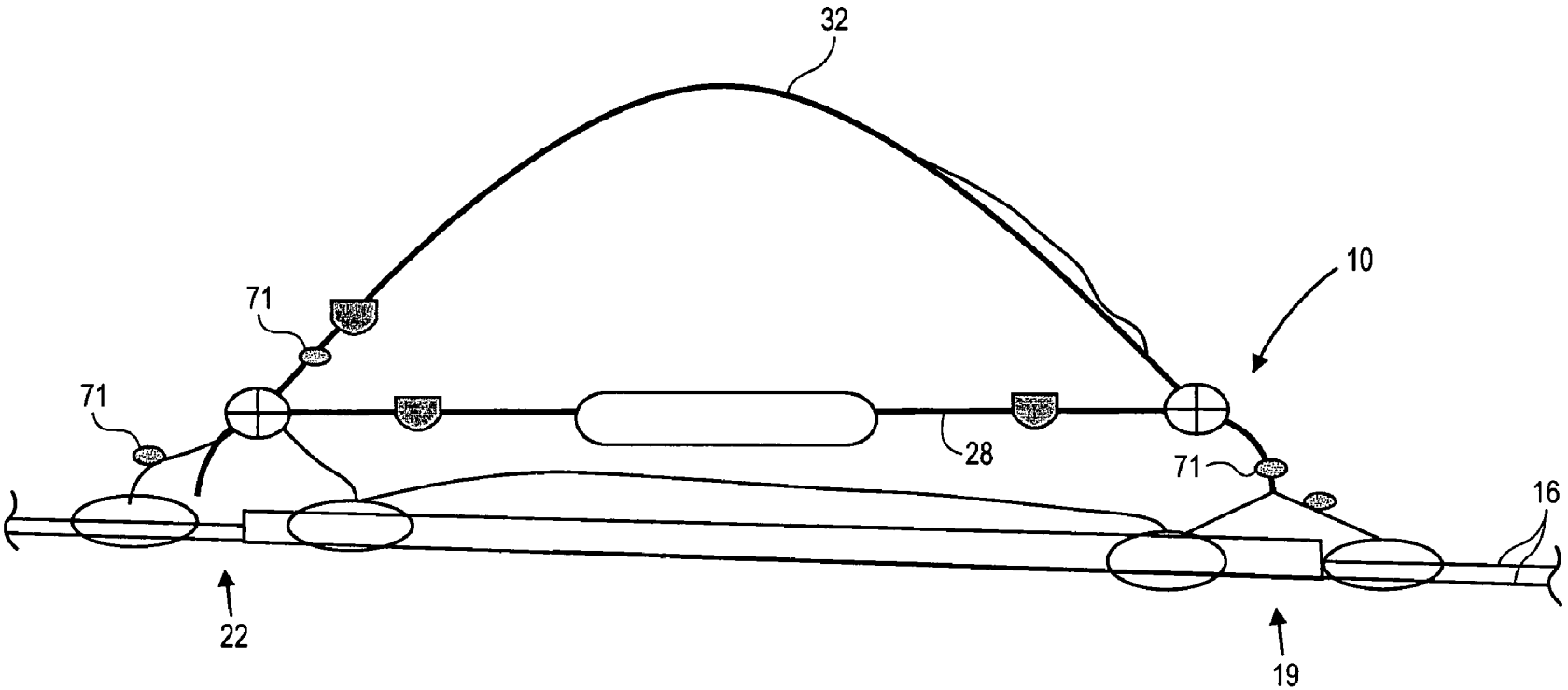
FIG. 1B is a diagrammatic view similar to FIG. 1A showing various components that may be implemented with the embodiments of FIG. 1A.

The invention includes a basic strap 10 with a removeable padded carrying handle 13. This device is shown in FIGS. 1A, 1B, and 2B. As shown, the basic strap 10 is connected to a pair of skis 16 by respective y-portions 19, 22 above and below pairs of bindings 25, 26 on the pair of skis 16. The y-portions may be provided by respective bifurcated straps connected to opposite ends of a basic main strap 28. The basic main strap may take the form of a wider strap, a rigid member, or a semi-rigid longitudinal member. In any case, the y-portions 19, 22, also referred to as bifurcated straps, extend from the basic main strap 28 in locations corresponding to positions immediately above and below each of a pair of bindings 25, 26 on the pair of skis. Thus, the basic strap 10 prevents slipping of the skis in either direction when a user grasps the basic strap 10 by the carrying handle 13, even when the skis 16 are oriented generally vertically. In fact, because straddling ends including ski holding mechanisms that engage the skis above and below each of the bindings, the skis 16 may be rotated 360 degrees in a vertical plane without slipping our of the basic strap. The ski holding mechanisms may include respective loops formed on each end of the y-portions 19, 22 of the basic strap 10. These loops may be closed in surrounding relation on the skis by hook and loop fasteners, buckles, snaps, clips, hooks, or other quick release mechanisms. As shown, a variety of D-rings 29 and other fastening and/or adjusting elements may be implemented with the basic strap 10. In particular, a removable shoulder strap 32 can be attached to the basic strap by quick release connections 34, 36, as shown. It is also to be understood that the basic main strap 28 and the y-portions 19, 22 may be formed as an integral unit of a continuous piece of fabric or plastic. Additionally or alternatively, the basic main strap 28 and the y-portions 19, 22 may be adjustable by a buckle and/or other clamping mechanism that may hold strap portions in adjustable overlapping configurations.

Figure 2A:
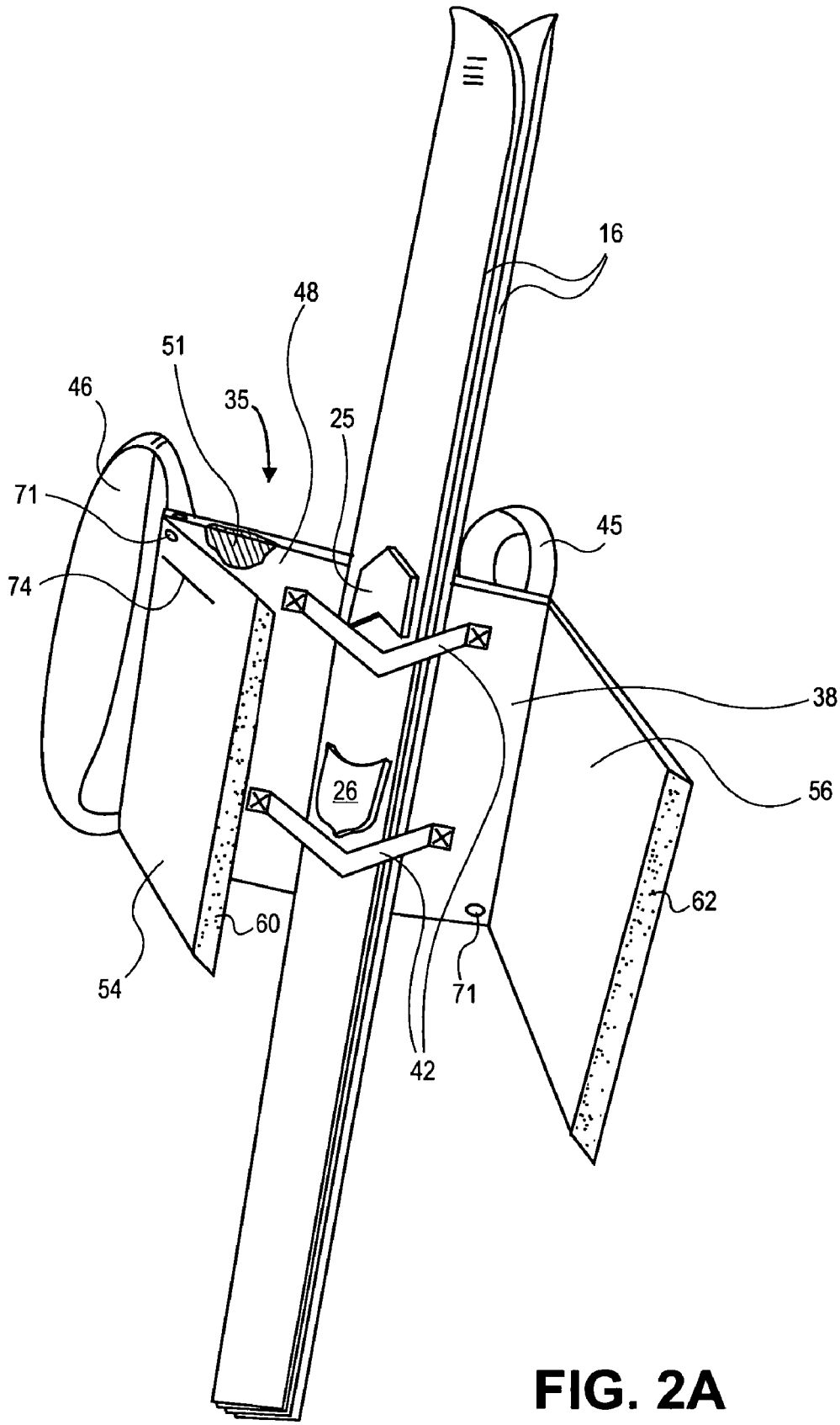
FIG. 2A is a front plan view of a backpack strap with a pair of skis supported thereon according to an embodiment of the present invention.
Figure 2B:
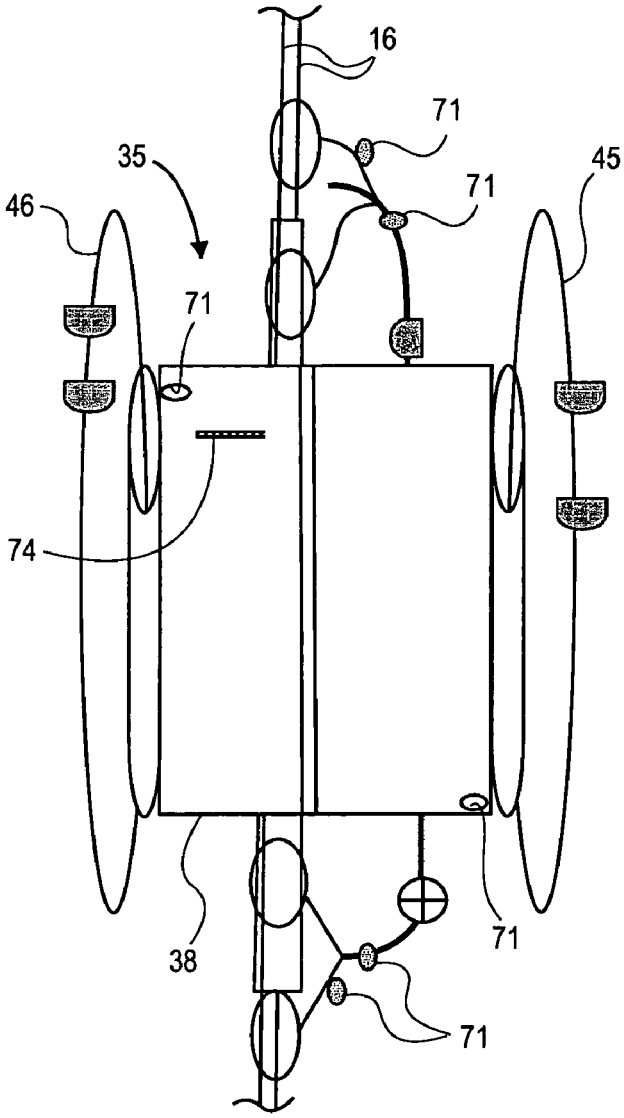
FIG. 2B is a diagrammatic view similar to FIG. 1A showing various components that may be implemented with the embodiments of FIG. 1A.

The embodiment of FIGS. 2A-2B may include the basic strap 10, as it remains attached to the skis 16. A further device for carrying the skis is also shown as a backpack strap 35. The backpack strap may include a bifold or trifold substrate 38 that receives the skis 16 and supports them as shown in FIG. 2A. To this end, there may be one or more binding engaging strap(s) 42 that support the skis 16 by engaging the bindings 25, 26. These straps 42 may be V-shaped or otherwise provided with a measure of slack to receive the skis 16, but inhibit passage of the bindings therethrough. The backpack strap 35 may includes shoulder straps 45, 46 connected to the substrate 38 of a back pad 48. The binding engaging strap(s) 42 may be attached to a first ski engaging side of the substrate 38 and the shoulder straps may be attached to an opposite back engaging side of the substrate 38 so that the substrate 38 acts as a buffer between the skis 16 and bindings 25, 26, and the user's back. At the same time, the backpack strap 35 advantageously provides convenient use similar to putting on a backpack. It is to be understood that other configurations are also possible, including but not limited to attachment of the shoulder straps 45, 46 along edges of the back engaging portion, along upper and lower edges, shoulder straps 45, 46 integrally formed with the substrate, or provided as an article of clothing that may include other components in addition to shoulder engaging portions.

The back pad 48 may include a stiffening material 51 in the back pad 48 to prevent discomfort from the bindings 25, 26 on a user's back. This material 51 may be disposed throughout the substrate 38, or may be limited to a back pad area that will generally overlie a user's back. Preventing discomfort may be accomplished by placing a stiffening member and/or padding within a fabric of the back pad. As may be appreciated, the material 51 may include one or more of foam, stiff foam, cellulosics, gel, natural fibers, wood, stiff or flexible plastics, and fabrics. Alternatively or additionally, the backpack strap may be formed of a single integral piece that may be stiffened or cushioned in a back engaging area.

As shown in FIGS. 2A and 2B, the skis 16 may be supported in the backpack strap 35 with the basic strap 10 attached to the skis or without the basic strap attached. The flaps 54 and 56 may be folded over a central portion of the back pad 48 and the skis 16, and closed by velcro strips 60, 62, or the like. Then the user may don the backpack strap 35 and carry the skis 16 on his or her back. When the skis are removed from the backpack strap 35, the backpack strap 35 may be worn outside, or inside, a skier's jacket with very little bulk added. On the other hand, the backpack strap has the convenience of enabling a skier to easily carry a pair of skis 16 on his or her back.

Figure 2C:
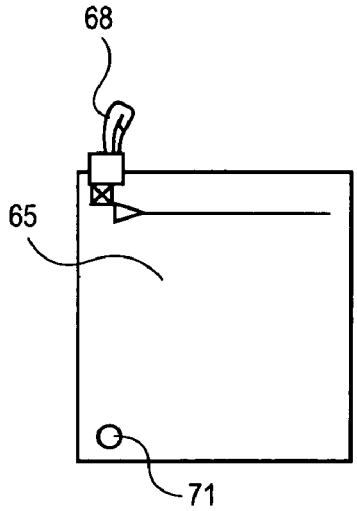
FIG. 2C is a diagrammatic view of a carry bag of the present invention that may be implemented with any of the embodiments thereof.

FIG. 2C includes a storage 65 bag that may be used to carry unused straps, goggles, or other accessories. This bag may be hung by a releaseable clip 68 from any one of a number of grommets 71 shown as small rounded elements in FIG. 1A-2B. When not in use, the storage bag 65 may be stored in a zipper closeable pocket 74 in the back pad 48.

One or more of the grommets 71 may be sized to receive a lockable cable so that the skis, basic strap 10, and/or backpack strap 35 may be temporarily secured to a rack. As shown in FIGS. 1A and 1B, the shoulder strap 32 may further include a removeable "charm" strap 77 for souvenirs.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. For example, it is to be understood that the various attachment mechanisms, adjustment mechanisms, and securing mechanisms of the present invention may be interchanged with each other without departing from the spirit and scope of the invention. Among others mechanisms, a resilient tongue and socket quick release mechanism may be used in place of or in addition to each of the attachment and securing mechanisms of the present invention described above.

The invention claimed is:

1. A method of supporting, orienting and carrying of a pair of skis as a unit, the method comprising:

placing the skis within a backpack strap;

supporting a pair of bindings of said skis within a pair of v-shaped straps, each said v-shaped strap secured to a substrate of said backpack strap at each end forming the v-shape in the longitudinal direction of the pair of skis;

positioning said pair of v-shaped straps respectively underneath said pair of bindings to support the bindings while allowing the pair of skis to extend therethrough and holding said pair of skis against said substrate;

closing the backpack strap by surrounding the skis and covering the v-shaped strap with a pair of flaps extending from said substrate of the backpack strap wherein said pair of flaps of said substrate has a closed configuration and an open configuration;

attaching a pair of shoulder straps to said substrate;

securing the backpack strap in a closed configuration by overlapping said pair of flaps of said substrate; and supporting the skis on a back of a user by said pair of shoulder straps.

2. The method of claim 1, further comprising:

securing the pair of skis to a ski strap by a pair of straps having looped portions that are engaged about a pair of bindings on said pair of skis;

retaining said pair of bindings along said ski strap via said looped portions positioned about each of said pair of bindings;

adjusting the length of the ski strap to manipulate the pair of skis by the user; and attaching a shoulder strap to the ski strap adjacent said looped portions of said pair of straps and supporting the ski strap and the pair of skis by the shoulder strap on the user's shoulder.

3. The method of claim 2, further comprising adjusting the length of the ski strap to have minimal slack to facilitate the manipulation of the skis by the user.

4. The method of claim 2, further comprising connecting a D-ring to the ski strap to attach accessories.

5. The method of claim 2, further comprising securing a grommet to the ski strap for lockingly receiving a cable therethrough.

6. The method of claim 2, further comprising supporting gear on the ski strap by connecting at least one quick release device, wherein the at least one quick release device is for supporting the gear thereon.

7. The method of claim 6, wherein the gear is selected from the group consisting of gloves, goggles, goggle totes, hats, ski pass pockets, water carrying devices, and/or strap-stashs.

* * * * *